US007201001B2

(12) United States Patent
Arman

(10) Patent No.: US 7,201,001 B2
(45) Date of Patent: Apr. 10, 2007

(54) RESONANT LINEAR MOTOR DRIVEN CRYOCOOLER SYSTEM

(75) Inventor: Bayram Arman, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 416 days.

(21) Appl. No.: 10/806,429

(22) Filed: Mar. 23, 2004

(65) Prior Publication Data

US 2005/0210887 A1 Sep. 29, 2005

(51) Int. Cl.
*F25B 9/00* (2006.01)

(52) U.S. Cl. ..... 62/6; 62/295

(58) Field of Classification Search ..... 62/6, 62/295

See application file for complete search history.

(56) References Cited

U.S. PATENT DOCUMENTS 2,420,276 A * 5/1947 Wood ..... 248/569
5,129,232 A 7/1992 Minas et al. ..... 62/51.1
5,363,077 A 11/1994 Herd et al. ..... 335/216
5,904,046 A * 5/1999 Kawano ..... 62/6
6,374,617 B1 4/2002 Bonaquist et al. ..... 62/6
6,378,312 B1 4/2002 Wang ..... 62/6
6,578,364 B2 6/2003 Corey ..... 62/6
6,604,363 B2 8/2003 Corey et al. ..... 62/6
6,640,553 B1 11/2003 Kotsubo et al. ..... 62/6
6,644,038 B1 11/2003 Acharya et al. ..... 62/6
6,938,426 B1 * 9/2005 Acharya et al. ..... 62/6
2002/0178736 A1 * 12/2002 Corey et al. ..... 62/6

* cited by examiner

*Primary Examiner*—William C. Doerrler
(74) *Attorney, Agent, or Firm*—David M. Rosenblum

(57) ABSTRACT

A resonant linear motor driven cryocooler system, particularly suited for providing refrigeration to a magnetic resonance imaging system, wherein vibrations from the resonant linear motor and noise from pulsed gas are isolated from the cryocooler by work transfer piping comprising connecting tubing and preferably a dashpot, and wherein the connecting tubing has a volume which exceeds the internal stroke volume of the resonant linear motor.

7 Claims, 1 Drawing Sheet

RESONANT LINEAR MOTOR DRIVEN CRYOCOOLER SYSTEM

TECHNICAL FIELD

This invention relates generally to low temperature or cryogenic refrigeration such as pulse tube refrigeration.

BACKGROUND ART

A recent significant advancement in the field of generating low temperature refrigeration is the development of cryocoolers, such as the pulse tube system, wherein pulse energy is converted to refrigeration using an oscillating gas. Such systems can generate refrigeration to very low levels sufficient, for example, to liquefy helium. One important application of the refrigeration generated by such cryocooler systems is in magnetic resonance imaging systems. Other cryocooler systems are Gifford-McMahon cryocoolers and Stirling cryocoolers.

Conventional high frequency resonant linear motor driven cryocoolers employ an integrated cold head and driver unit. In this conventional arrangement the resonant linear motor is used as a mounting platform for the cold head or cryocooler resulting in a compact system with lower pressure-volume work losses.

One disadvantage of the conventional integrated system is that vibrations from the resonant linear motor, especially when the resonant linear motor is operating at a high frequency, may adversely affect the operation of the load to be cooled. This is particularly a problem when the cryocooler is employed to provide cooling to a magnetic resonance imaging system because the vibrations may interfere with the ability of the imaging system to provide effective clear imagery. Another disadvantage of the conventional integrated system is not having enough space on the magnet system to accommodate larger resonant linear motors.

Accordingly, it is an object of this invention to provide a resonant linear motor driven cryocooler system which can substantially avoid vibration transfer from the motor to the cryocooler while still enabling effective driving of the cryocooler by the motor.

SUMMARY OF THE INVENTION

The above and other objects, which will become apparent to those skilled in the art upon a reading of this disclosure, are attained by the present invention which is:

A resonant linear motor driven cryocooler system comprising:

(A) a resonant linear motor having an internal stroke volume;

(B) a cryocooler spaced from the resonant linear motor; and (C) connecting tubing extending from the resonant linear motor to the cryocooler, said connecting tubing having a volume which exceeds the internal stroke volume of the resonant linear motor.

As used herein the term "resonant linear motor" means an electroacoustic device generating high intensity acoustic power by axially reciprocating means, such as a piston, operating close to its resonant frequency to achieve high efficiency.

As used herein the term "internal stroke volume" means the maximum volume that the piston of a resonant linear motor displaces during one stroke in an oscillation.

As used herein the term "cryocooler" means a regenerative device producing refrigeration with pulsed power input.

As used herein the term "dashpot" means a device for cushioning or damping a movement. Preferably a dashpot comprises at least one of a spring, a mass, and a piston.

DETAILED DESCRIPTION

The invention will be described in detail with reference to the Drawings.

Figure 1:
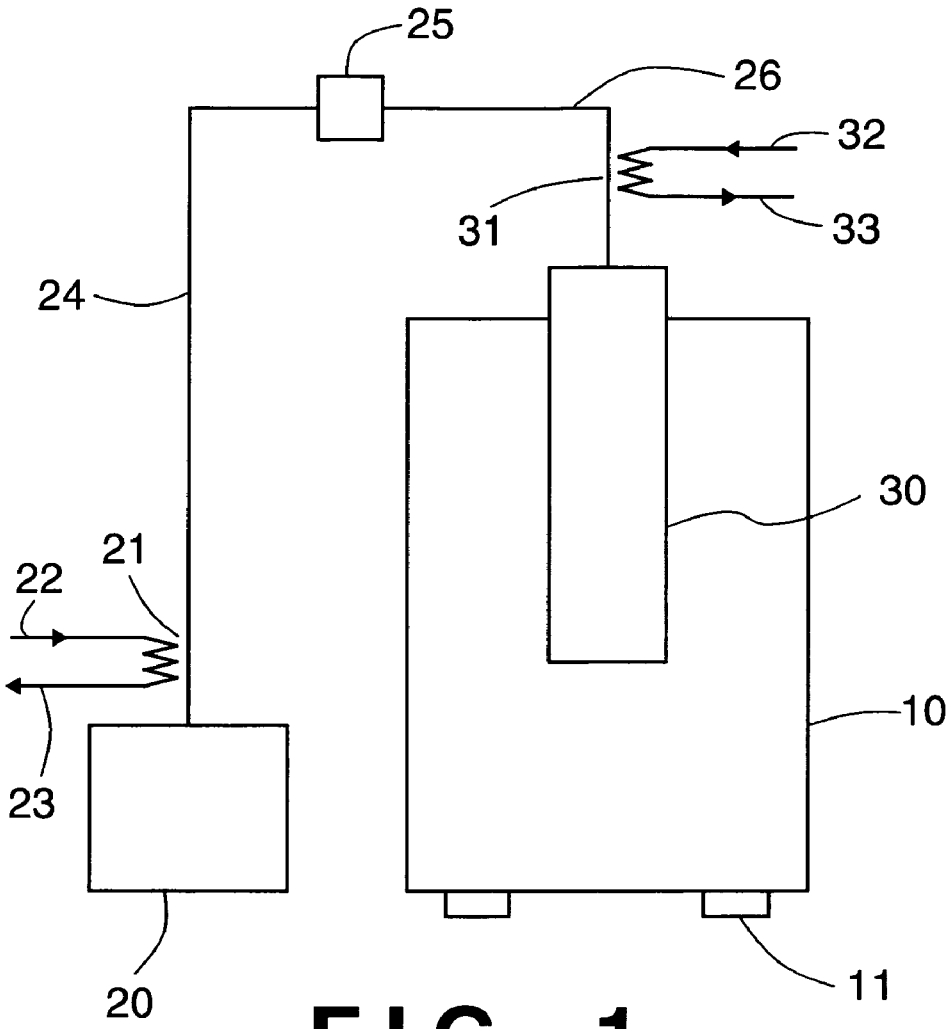
FIG. 1 is a simplified schematic representation of one preferred embodiment of the invention wherein the cryocooler is employed to provide refrigeration to a superconducting magnet system as may be employed in a magnetic resonance imaging system and a dashpot is positioned on the connecting tubing between the resonant linear motor and the cryocooler.

Referring now to FIG. 1, resonant linear motor 20 is electrically powered and operates at a frequency generally within the range of from 10 to 60 hertz, preferably less than 40 hertz, most preferably within the range of from 15 to 30 hertz. Resonant linear motor 20 has an internal stroke volume generally within the range of from about 1 cubic centimeter to about 10 cubic decimeters. A resonant linear motor is a reciprocating electroacoustic transducer that produces acoustic power employing a motor placed inside a cylinder. The motor is mounted with a piston and as it oscillates a pressure wave by the piston is created. This pressure and volume change as the motor-piston assembly oscillates (moves back and forth) is the acoustic power to drive the cryocooler. Usually the motor is suspended by a linear suspension system and its magnets move.

Oscillating gas from resonant linear motor 20 is passed to cryocooler 30 through connecting tubing 24, 26 which extends from resonant linear motor 20 to cryocooler 30. The volume of the connecting tubing exceeds the internal stroke volume of the resonant linear motor. Preferably the volume of the connecting tubing is at least twice the internal stroke volume of the resonant linear motor. Generally the volume of the connecting tubing will be within the range of from greater than 1 to about 5 times the internal stroke volume of the resonant linear motor.

Figure 2:
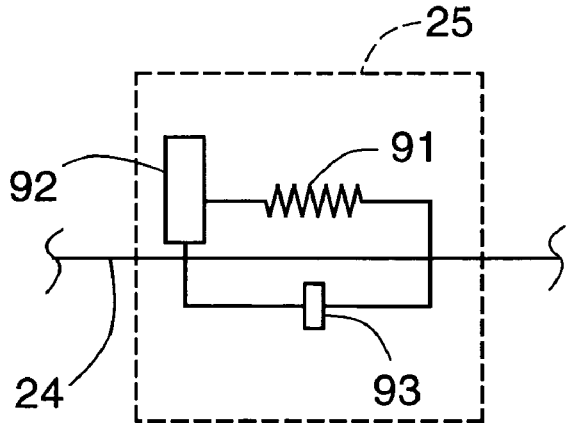
FIG. 2 is a representation of one preferred embodiment of a dashpot which may be used in the preferred practice of this invention.

Preferably, as shown in FIG. 1, dashpot 25 is positioned on connecting tubing 24, 26 between resonant linear motor 20 and cryocooler 30. Dashpot 25 may comprise, for example, the connecting tubing, a bellows arrangement, a spring, a piston, a curved pipe, and/or a flexible pipe. The isolation of the cryocooler or cold head from the resonant linear motor addresses the issues of mechanical vibrations as well as the noise in the pulsed gas flow oscillations. The mechanical vibrations will be better mitigated using one or more of the dashpot features such as spring 91, mass 92 and/or piston 93 as shown in FIG. 2. The undesired noise of the pulsed gas flow oscillations are mitigated by providing a pneumatic buffer, for example in the form of the connecting tubing volume having at least twice the volume of the linear motor piston displacement.

Preferably, as illustrated in FIG. 1, heat exchanger 21 is positioned between resonant linear motor 20 and dashpot 25. Heat exchange fluid 22, 23 passes through heat exchanger 21 and is employed to take heat from, i.e. to cool, the compressor resonant linear motor arrangement by indirect heat exchange.

Preferably, as illustrated in FIG. 1, heat exchanger 31 is positioned between cryocooler 30 and dashpot 25. Heat exchange fluid 32, 33 passes through heat exchanger 31 and is employed to take heat from, i.e. to cool the oscillating gas in tubing section 26 by indirect heat exchange.

In the case where the cryocooler 30 is a pulse tube cryocooler, the operation of the cryocooler is as follows. The pulse tube cryocooler comprises a regenerator in flow communication with a thermal buffer tube. The regenerator contains regenerator or heat transfer media. Examples of suitable heat transfer media include steel balls, wire mesh, high density honeycomb structures, expanded metals, lead balls, copper and its alloys, complexes of rare earth element (s) and transition metals. The pulsing or oscillating working gas is cooled in the regenerator by direct heat exchange with cold regenerator media to produce cold pulse tube working gas.

The thermal buffer tube and the regenerator are in flow communication. The flow communication includes a cold heat exchanger. The cold working gas passes to the cold heat exchanger and from the cold heat exchanger to the cold end of the thermal buffer tube. Within the cold heat exchanger the cold working gas is warmed by indirect heat exchange with a refrigeration load thereby providing refrigeration to the refrigeration load such as to cool superconducting magnet system 10 supported on vibration eliminating legs 11 as illustrated in FIG. 1. One example of a refrigeration load is for use in a magnetic resonance imaging system. Another example of a refrigeration load is for use in high temperature superconductivity.

The working gas is passed from the regenerator to the thermal buffer tube at the cold end. As the working gas passes into the thermal buffer tube, it compresses gas in the thermal buffer tube and forces some of the gas into a reservoir. Flow stops when pressures in both the thermal buffer tube and the reservoir are equalized. Cooling fluid is warmed or vaporized by indirect heat exchange with the working gas, thus serving as a heat sink to cool the compressed working gas.

In the low pressure point of the pulsing sequence, the working gas within the thermal buffer tube expands and thus cools, and the flow is reversed from the now relatively higher pressure reservoir into the thermal buffer tube. The cold working gas is pushed back towards the warm end of the regenerator while providing refrigeration and cooling the regenerator heat transfer media for the next pulsing sequence. The orifice and reservoir are employed to maintain the pressure and flow waves in appropriate phase so that the thermal buffer tube generates net refrigeration during the compression and the expansion cycles in the cold end of the thermal buffer tube. Other means for maintaining the pressure and flow waves in phase include inertance tube and orifice, expander, linear alternator, bellows arrangements, and a work recovery line. In the expansion sequence, the working gas expands to produce working gas at the cold end of the thermal buffer tube. The expanded gas reverses its direction such that it flows from the thermal buffer tube toward the regenerator. The relatively higher pressure gas in the reservoir flows to the warm end of the thermal buffer tube.

The expanded working gas is passed to the regenerator wherein it directly contacts the heat transfer media within the regenerator to produce the aforesaid cold heat transfer media, thereby completing the second part of the pulse tube refrigeration sequence and putting the regenerator into condition for the first part of a subsequent pulse tube refrigeration sequence.

Although the invention has been described in detail with reference to a preferred embodiment, those skilled in the art will recognize that there are other embodiments within the spirit and the scope of the claims. For example, other types of cryocoolers which may be employed in the practice of this invention include Gifford-McMahon cryocoolers and Stirling cryocoolers.

The invention claimed is:

1. A resonant linear motor driven cryocooler system comprising:

(A) a resonant linear motor having an internal stroke volume;

(B) a cryocooler spaced from the resonant linear motor; and (C) connecting tubing extending from the resonant linear motor to the cryocooler, said connecting tubing having a volume which exceeds the internal stroke volume of the resonant linear motor;

(D) a dashpot positioned on the connecting tubing between the resonant linear motor and the cryocooler; and (E) a heat exchanger positioned between the resonant linear motor and the dashpot or between the cryocooler and the dashpot.

2. The cryocooler system of claim 1 wherein the connecting tubing volume is at least twice the internal stroke volume of the resonant linear motor.

3. The cryocooler system of claim 1 wherein the dashpot comprises a mass.

4. The cryocooler system of claim 1 wherein the dashpot comprises a spring.

5. The cryocooler system of claim 1 wherein the dashpot comprises a piston.

6. The cryocooler system of claim 1 wherein the cryocooler is a pulse tube cryocooler.

7. The cryocooler system of claim 1 wherein the cryocooler is positioned to provide refrigeration to a superconducting magnet of a magnetic resonance imaging system.

* * * * *